US006257510B1

(12) United States Patent
Schuck

(10) Patent No.: US 6,257,510 B1
(45) Date of Patent: Jul. 10, 2001

(54) ADJUSTABLE EMISSION CHAMBER FLOW CELL

(75) Inventor: Raymond C. Schuck, Elba, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/376,115

(22) Filed: Aug. 17, 1999

(51) Int. Cl.[7] ..... B02C 19/18
(52) U.S. Cl. ..... 241/1; 241/21; 241/301
(58) Field of Search ..... 241/1, 301, 283, 241/21

(56) References Cited

U.S. PATENT DOCUMENTS 4,131,238 * 12/1978 Tarpley ..... 241/283
5,988,396 * 11/1999 Minkara et al. ..... 241/1

OTHER PUBLICATIONS

Roger R.C. New, "Liposomes—A Practical Approach", Chapter 2, pp. 33, 44–48 & 258.
P. Greguss, "A New Sonic Emulsifying System: A Preliminary Report", 1972, vol. 10, pp. 276–278.
L. I. Tertykh et al, "Influence of Ultrasonics on the Formation of Emulsions of Polyethylhydrosiloxane", 1973, pp. 41–43.
Howard Alliger, "Ultrasonic Disruption", 1975, pp. 75–84.
A. Grange, "Ultrasonic Homogenisers—Their Development and Application", 1982, pp. 423–424.
R. Zana et al, "Ultrasonic Investigation of Critical Behavior & Percolation Phenomena in Micro–Emulsions", 1982, L–829–837.
Kirsten Eberth et al, International Journal of Pharmaceutics, vol. 14, 1983, pp. 349–353.
Fredric M. Menger et al, Journal of Colloid and Interface Science, vol. 129, No. 1, 1989, pp. 185–191.
David J. Wedlock, "Production of Vesicles of Defined Size", 1994, p. 291.

* cited by examiner

*Primary Examiner*—Mark Rosenbaum
(74) *Attorney, Agent, or Firm*—Paul A. Leipold

(57) ABSTRACT

The invention relates to a method of particle treatment providing a stream of particles in liquid applying said stream to an ultrasonic probe wherein said stream has an orifice surrounded by a plate that is generally parallel to the emitting surface of said probe and wherein said plate is adjustable to vary its distance from said emitting surface.

13 Claims, 2 Drawing Sheets

ADJUSTABLE EMISSION CHAMBER FLOW CELL

FIELD OF THE INVENTION

This invention relates to the forming of emulsions or suspension containing small particles into smaller particles by application of a stream of material to an ultrasonic probe.

BACKGROUND OF THE INVENTION

It is known in the formation of emulsions that are consisting of oil and water to apply forces to these emulsions to decrease the size of the oil phase droplets or particles. It is known to utilize mills such as colloid mill, high speed shear mixer, and various jet homogenizer apparatus to do this. Further is known use stacks of perforated plates through which the dispersion is forced. The use of these types of apparatus for decreasing particle size has the disadvantage that it results in emulsions that do not have a uniform particle size distribution. Further these devices require high energy in order to accomplish the particle size reduction.

It is also known to place ultrasonic probes into containers of emulsion in order to decrease the particle size. However, this technique results in oil and water emulsions that have a wide distribution of particle size. Further, it has been known to place ultrasonic probes into streams of particles and liquid in order to pass these particles by the probe to reduce the particles size. These also have the disadvantage that the particles are not uniform in size.

In the formation of photographic materials that are dispersions of particles coupler material and permanent solvent suspended in a gelatin water solution, there is a continuing need for accurate particle sizing of these solutions. These suspensions are more properly in chemical practice called emulsions; however, in the photographic art it is commonly known to refer to these emulsions as "dispersions" of couplers. In the photographic art, "emulsions" refer to suspensions of silver halide particles.

PROBLEM TO BE SOLVED BY THE INVENTION

There is a need for a method and apparatus of providing a reduction in particle size in oil and water emulsions that is low in cost, provides uniform particles, and is adjustable to provide differing size particle output from the same feed stream.

SUMMARY OF THE INVENTION

It is an object of the invention to overcome the disadvantages of prior methods of sizing particles in liquids.

It is another object to provide apparatus and method for forming more uniform emulsions of particles.

It is a further object of the invention to provide improved method of forming and adjusting the size of particles suspended in a liquid stream.

These and other objects of the invention are accomplished by a method of particle treatment comprising providing a stream of particles in liquid, applying said stream to an ultrasonic probe wherein said stream has an orifice surrounded by a plate that is generally parallel to the emitting surface of said probe and wherein said plate is adjustable to vary its distance from said emitting surface.

ADVANTAGEOUS EFFECT OF THE INVENTION

The invention provides a method of forming uniform particle distributions and easy regulation of the particle size.

DETAILED DESCRIPTION OF THE INVENTION

The invention has numerous advantages over prior practices in the art. The invention provides a method of providing differing size particles of oil and water emulsions. The apparatus of the invention provides easily reproducible results. The invention provides a continuous method of reducing particle size and is operable with virtually any materials that contain particles in a liquid. The operation is efficient and low in cost. Further the apparatus is easily adjustable to provide differing size particles. These and other advantages will be apparent from the detailed description below.

Figures 1, 1A, 1B:
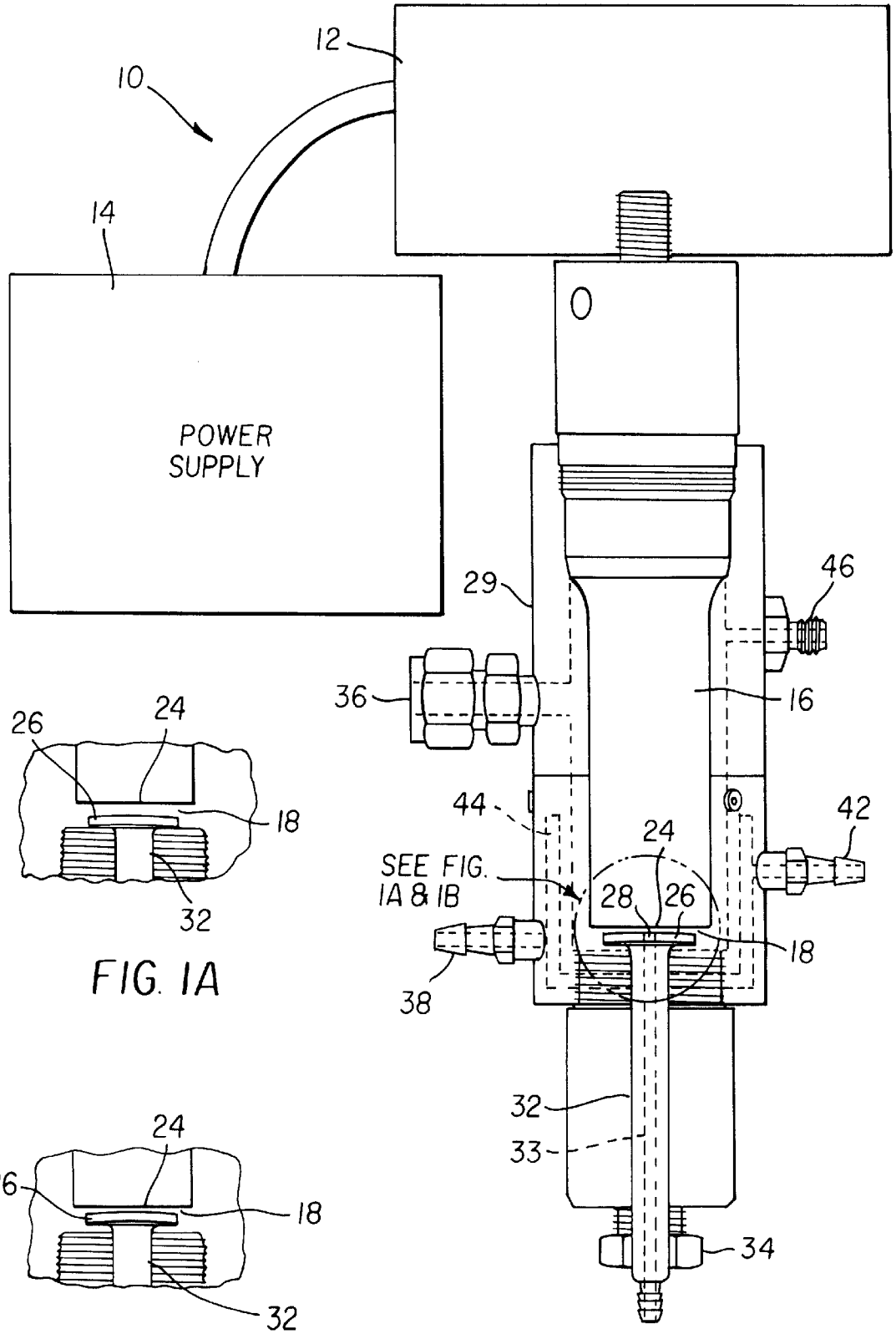
FIG. 1 is a schematic illustration in cross-section of the apparatus of the invention for treatment of a single stream of material.

Illustrated in FIG. 1 is an apparatus 10 in accordance with the invention. The apparatus comprises a power supply 14 that is connected to the converter 12. The converter is attached to the horn or probe 16. The probe 16 has emitting surface 24 that forms one side of chamber 18 with the other side of the chamber 18 being platen 26 that is a part of lower adjustment means 32. The lower adjustment or intensity regulator 32 has a channel 33 through which a liquid stream may be applied to exit at orifice 28. When the stream exits orifice 28, it is projected against the emitting surface 24 of the ultrasonic horn 16. The casing 29 is provided with a chamber 44 through which fluid may be run to heat or cool the chamber 44. These fluids enter at orifice 38 and leave through exit orifice 42. The casing 29 further provided with vent 46 that allows discharge of air from system when it is first charged. When the apparatus is in use, fluid enters through channel 33 and is projected against the emitting surface 24 in chamber 18. Chamber 18 is formed by the separation between the emitting surface of probe 16 and the upper surface of platen 26. The particle size of the particles in the stream is reduced in chamber 18 and then exit chamber 18 for removal through outlet 36 leading to a pipe not shown. The intensity regulator 32 may be provided with markings 37 to aid in knowing what chamber size is being set by tightening nut 34 to expand a sealing washer not shown.

The nut 34 serves to tighten the adjustment means 32 in position so as to regulate the size of the chamber 18. A device such as an elastomeric washer may be used to hold the stem of 32 in a position when compressed by nut 34. With reference to FIG. 1A and 1B, it is shown that by moving platen 26 toward the emitting device 24 or away from 24, the size of the chamber 18 may be increased or decreased. A larger chamber such as in FIG. 1A results in larger particle size than a smaller chamber such as in FIG. 1B.

Figures 2, 2A, 2B:
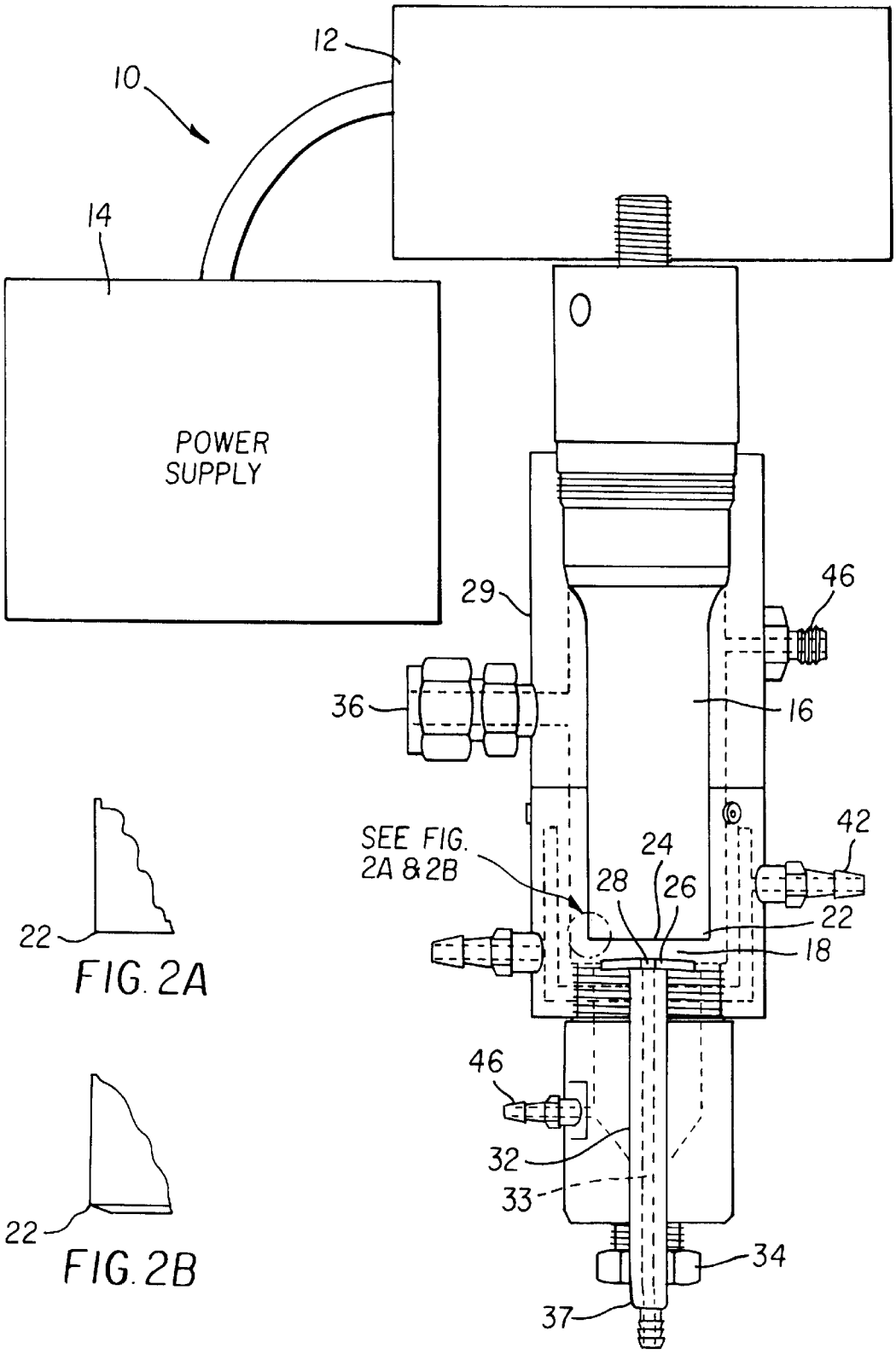
FIG. 2 is a schematic illustration in cross-section of apparatus of the invention for treatment of multiple streams of material.

The device 11 of FIG. 2 has been provided with another inlet 46. Fluid entering at 46 passes up around the edge of platen 26 and is subjected to ultrasonic treatment, although in a much smaller amount than material that enters at orifice 28. This orifice also may be utilized as the device for mixing of material that does not contain particles with the reduced particle size material leaving chamber 18. For instance, if the emulsion of particles of coupler material with permanent solvent is introduced through orifice 18 for particle size reduction, a gelatin and water solution could be introduced through 46 to reduce or increase the viscosity of the system. Additives could also be added to improve other properties. Additives also could be added through 46 in order to obtain mixtures of materials.

As shown in FIG. 2A and 2B, the horn may preferably be modified such that its emitting surface has a chamfered edge. The most common edge for an ultrasonic horn is the 90 degree edge such a shown in the FIG. 2A. However, it has been surprisingly found that a chamfered edge such as in 2B results in higher output and more efficient particle production than the 90 degree edge. A chamfered edge of between 10 and 30 degrees from the emitting surface plane has been found to be preferred. The most preferred chamfered angle is between about 15 and about 20 degrees from the plane of the emitting surface and has been found to reduce the most efficient formation of uniform particles.

Any suitable particle material may be utilized in the instant apparatus and method. The particles may be solid or agglomerations of particles. Typical of such materials are crystalline particles of polymers and ceramic materials. Further in a preferred method, the apparatus may be utilized for oil particles in water or for any other material that are suspended in a liquid and can be applied to the emitting surface of the ultrasonic horn. A preferred material has been found to be dispersions of coupler and permanent solvent particles in a gelatin and water solution. These are preferred, as there is a need for formation of these materials into uniform particles, as uniform particles produce uniform results in photographs.

The device of the invention preferably is formed from stainless steel or titanium alloy. Brass is also suitable, particularly for the lower adjustable platen. The ultrasonic probe or horn is typically available commercially. However, the inventive chamfered of the edge of the invention is not commercially available.

While the means for adjusting the distance between the platen and the emitting surface has been set forth as a sliding member that is tightened by a nut, other methods of adjustment include hydraulic controls to raise and lower the platen. The device also could be provided with electronic drive control for the platen. Further the controls could be by simple manual adjustment or any other suitable means.

While the orifice 28 for introducing the stream of particle containing material is shown as at the center of the platen in some instances it could be off center. However, generally it is preferred that it be in the center for most efficient application of ultrasonic energy to the stream. Further, while the second stream is shown as entering at orifice 46, it also could be injected into the chamber 18 by a horizontal stream or even placed in the casing nearer the exit 36. However, the placement of the second stream such that it enters around the edge of the platen is considered to give the best mixing.

The device of the invention, as it has practically infinite adjustment for the size of chamber 18, provides a very easy, reliable, and repeatable method of particle reduction of materials in a stream of liquid. Generally the smaller the chamber separation, the smaller the particle and the more uniform. However, in some instances a wider particle size distribution is desirable and in those instances a greater separation between the emitting surface and the platen may be utilized.

It is also possible that a stream of material could be passed by the end of a rectangular transducer in a channel bounded by a platen to provide a longer time of exposure.

The following examples illustrate the practice of this invention. They are not intended to be exhaustive of all possible variations of the invention. Parts and percentages are by weight unless otherwise indicated.

EXAMPLES

"Adjustable Emission Chamber Flow Cell Experiment"

This experiment is to answer the question: Can oil-in-water emulsions be produced by a continuous process (flow-cell) using ultrasonic energy. This product must have a particle size <0.300 $\mu$m and be of sufficient quantity >1 g to be used in preparing solutions to be used in photographic research.

In the description that follows oil-in-water emulsions will be referred to in photographic jargon, i.e. "dispersions".

Apparatus:

1. Delivery system is a Harvard Infusion/Withdrawal Syringe Pump from Harvard Apparatus Company, Inc. of Millis, Mass.
2. Fitted with 2×50 ml syringes (from Hamilton Syringe Co.).
3. Sonics and Materials, Inc. is the manufacturer of the ultrasonic processor used in this experiment. It is a model VCX 600 (system includes power supply and converter {transducer}) operating at a frequency of 20 KHz.
4. Various probes may be used to transmit ultrasonic energy from the converter to the material to be processed. In this example a 25 mm diameter circular emitting surface probe (p/n 630-0209) fitted to a standard tempered flow cell (p/n 830-00050) from Sonics and Materials, Inc. is used. A device such as in FIG. 2 with the adjustable chamber is used. After processing the resultant dispersion can also be mixed with one or more reagents by introducing them into flow cell chamber through the second opening 46 for mixing at the point of greatest turbulance and then dispensed from the output port.

Experimental Process:

In Solution A, a model chemical compound (Coupler A) was dissolved in an oil (tritolyl phosphate) along with an auxiliary solvent (ethyl acetate). Solution B, a 5% gel solution, was also prepared with suitable surfactant to aid particle stabilization. Both solutions were mixed at 60° C. The output collected and evaluated by various methods (microscopy), turbidimetrically, capillary hydrodynamic fractionation (CHDF), and sensitometrically. Partical sizing by CHDF generates data which includes the average diameter a sphere containing a volume equal to the volume of the average size particles is reported by the value Dv. This value Dv was the value used to compare the output of the following experiments.

Experiment #1:

Solution A (organic) in syringe A and solution B (gel) in syringe B were simultaneously driven by Harvard apparatus at a combined flow rate of 10.6 g/min through the aforesaid adjustable emission chamber of FIG. 2, all at a temperature of 60° C. The streams A and B were joined prior to entering channel 33 for application into the chamber 18. The VCX 600 ultrasonic processor was connected to a 25 mm probe attached to the aforesaid flow cell. The VCX 600 was operating at 100% amplitude with the power meter indicating that 200–300 watts were used to drive this process .

Processed liquid called product was collected after 1, 2, 3, 4 and 5 minutes and thereafter analyzed. All samples were suitable for photographic purposes.

Experiment #2:

The adjustable emission chamber apparatus of FIG. 2 the invention was modified to include the following feature: a scale was marked on the lower portion of the intensity regulator so that the gap between the platen surface and the emitting surface of the probe could be fixed at various positions. This would allow processing at different chamber volumes as determined by the gap between platen and probe surfaces.

In part 1 of Experiment #2, the premixed organic solution A and the gel solution B were mixed in a beaker for 10 min at 60° C. on a hot plate stirrer with a magnetic stir bar. The resultant mixture was measured and found to have a bimodal curve shape of particles with peaks at 1.151 and 5.122 $\mu$. I set the intensity regulator platen for a gap of 0.4 cm, chamber volume of 2 $cm^3$, and a residence time of 11 seconds. The Harvard apparatus flow rate was 10.6 cc/minute and collected two samples DV 55–70 nm range.

Part 2 of Experiment #2: I set the gap to 0.1 cm and repeated the experiment above. The premixed solutions were measured and again found a bi-modal curve shape of particles with peaks at 1.151 and 7.697 $\mu$. At a gap of 0.1 cm chamber volume is about 0.5 $cm^3$ with a residence time of 2.8 sec., with a flow rate of 10.6 cc/min using the same Harvard apparatus. I collected two samples which had DV in range of 50–53 nm.

My best batch process for 10 g uses the same probe and takes 30 seconds to complete processing to DV~50 nm.

Conclusion: In-line continuous processing is more efficient when gap is narrowed and emission chamber size is adjusted so that liquid to be processed is confined more closely to the probes emitting surface. However, particle size reduction is effectively produced at gaps of 0.1 cm to 0.4 cm. Flow rate, temperature, viscosity, emission amplitude, and probe surface are also important variables. Suitable gaps would be 0.05 to 3 cm. At larger gaps there is only a small improvement over batch treatment with a probe in a container. Preferred gap would be 0.1 to 0.5 for effective particle size reduction and uniform sizing.

APPENDIX

Coupler A

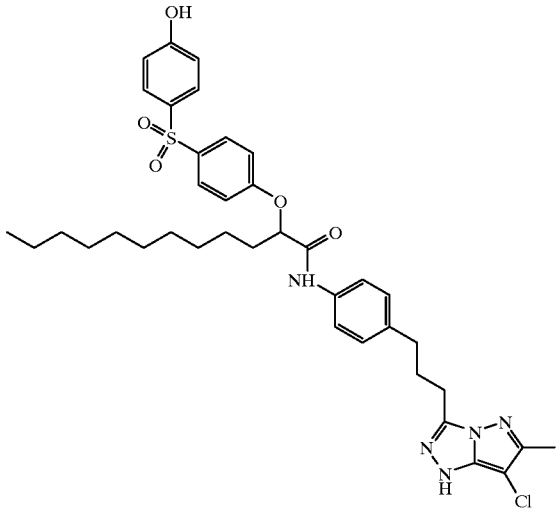

The invention has been described in detail with particular reference to certain preferred embodiments thereof, but it will be understood that variations and modifications can be effected within the spirit and scope of the invention.

What is claimed is:

1. A method of particle treatment comprising providing a stream of particles in liquid applying said stream to an ultrasonic probe wherein said stream has an orifice surrounded by a plate that is generally parallel to the emitting surface of said probe and wherein said plate is adjustable to vary its distance from said emitting surface wherein said emitting surface is planar and has chamfered edges.

2. The method of claim 1 wherein said stream is applied generally to the center of said emitting surface.

3. The method of claim 1 wherein the liquid and treated particles are continuously removed from between the emitting surface and said plate.

4. The method of claim 1 wherein the chamfered edges of said emitting surfaces are at an angle of between 10 and 30 degrees from the emitting surface.

5. The method of claim 4 further comprising providing a second stream of liquid that joins the treated stream at the edge of said plate.

6. The method of claim 1 wherein said particles comprise oil droplets in water.

7. The method of claim 1 wherein said particles comprise solid particles.

8. The method of claim 4 wherein said particles comprise coupler and permanent solvent.

9. An apparatus for particle treatment comprising an ultrasonic probe having an emitting surface, a platen arranged generally parallel to said emitting surface, an orifice in said platen, means to adjust the distance of said platen from said emitting surface wherein said emitting surface is planar and has chamfered edges.

10. The apparatus of claim 9 comprising means to withdraw treated liquid from the treatment area between said platen and said emitting surface.

11. The apparatus of claim 9 further comprising means to apply a stream of material around the outer edge of said platen.

12. The apparatus of claim 9 further comprising temperature control means to regulate the temperature of said apparatus.

13. The apparatus of claim 9 wherein said chamfered edge is at an angle of between 10 and 30 degrees from the emitting surface.

* * * * *